US010350893B2

(12) United States Patent
Nakagawa et al.

(10) Patent No.: US 10,350,893 B2
(45) Date of Patent: Jul. 16, 2019

(54) INKJET PRINTING APPARATUS

(71) Applicant: CANON KABUSHIKI KAISHA, Tokyo (JP)

(72) Inventors: Yoshinori Nakagawa, Kawasaki (JP); Atsushi Arai, Yokohama (JP); Masaya Uetsuki, Yokohama (JP); Toshimitsu Danzuka, Tokyo (JP); Kazuo Suzuki, Yokohama (JP); Masataka Kato, Yokohama (JP); Tsuyoshi Ibe, Yokohama (JP); Shin Genta, Yokohama (JP); Tatsuaki Orihara, Tokyo (JP); Tomoki Yamamuro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/627,263

(22) Filed: Jun. 19, 2017

(65) Prior Publication Data

US 2017/0368830 A1 Dec. 28, 2017

(30) Foreign Application Priority Data

Jun. 24, 2016 (JP) ..... 2016-125594

(51) Int. Cl.
*B41J 2/165* (2006.01)
*B41J 2/045* (2006.01)

(52) U.S. Cl.
CPC ..... *B41J 2/16517* (2013.01); *B41J 2/04535* (2013.01); *B41J 2/16523* (2013.01); *B41J 2/0456* (2013.01); *B41J 2002/16573* (2013.01)

(58) Field of Classification Search
CPC ..... B41J 2/16517; B41J 2/04535; B41J 2/16523; B41J 2/0456; B41J 2002/16573
See application file for complete search history.

(56) References Cited

U.S. PATENT DOCUMENTS

2006/0197983 A1* 9/2006 Hatanaka ..... B41J 2/2107 358/1.18

FOREIGN PATENT DOCUMENTS

| | | | |
|---|---|---|---|
| JP | 2001-301201 | A | 10/2001 |
| JP | 2006-341589 | A | 12/2006 |
| JP | 2007-245386 | A | 9/2007 |

* cited by examiner

*Primary Examiner* — Geoffrey S Mruk
(74) *Attorney, Agent, or Firm* — Canon U.S.A., Inc. IP Division

(57) ABSTRACT

An inkjet printing apparatus includes a head, a platen, a platen absorbent that temporarily stores ink ejected from the head, a waste ink storage container that stores the ink discharged from the platen absorbent, and an estimation unit that, in a case where the platen is divided into a plurality of regions in a direction intersecting a conveyance direction of the printing medium, estimates an amount of ink stored in the waste ink storage container based on a position of a region to which the ink is ejected by the head and an amount of ink ejected to the region.

18 Claims, 9 Drawing Sheets

FIG. 5

| DISCHARGE INFORMATION $M_n$ | REGION A | | | REGION B | | |
|---|---|---|---|---|---|---|
| | DISCHARGE AMOUNT $A_N$ | DISCHARGE TIME | ESTIMATED ARRIVAL TIME | DISCHARGE AMOUNT $B_N$ | DISCHARGE TIME | ESTIMATED ARRIVAL TIME |
| $M_0$ | 0.3g | 9:21:00 | 9:25:00 | 1.1g | 9:21:00 | 9:29:00 |
| $M_1$ | 0.7g | 9:21:10 | 9:25:10 | 0.2g | 9:21:10 | 9:29:10 |
| $M_2$ | 1.2g | 9:21:20 | 9:25:20 | 0.3g | 9:21:20 | 9:29:20 |
| ⋮ | ⋮ | ⋮ | ⋮ | ⋮ | ⋮ | ⋮ |
| $M_{120}$ | 0.8g | 9:41:00 | 9:45:00 | 0.9g | 9:41:00 | 9:49:00 |

FIG. 7

| ELAPSED TIME | PERCENTAGE OF REMAINING INK |
|---|---|
| ~1min | 95% |
| 1~5min | 90% |
| 5~10min | 85% |
| 10~30min | 80% |
| 30~120min | 75% |
| 120min~ | 70% |

FIG. 8

| DISCHARGE AMOUNT | TIME NEEDED UNTILL ARRIVAL | |
|---|---|---|
| | REGION A | REGION B |
| ~0.5g | 8min | 16min |
| 0.5~1.0g | 4min | 8min |
| 1.0~2.0g | 2min | 4min |
| 2.0~3.0g | 1min | 2min |
| 3.0~5.0g | 30sec | 60sec |
| 5.0g~ | 10sec | 20sec |

FIG. 9

| ELAPSED TIME | PERCENTAGE OF REMAINING INK | | | |
|---|---|---|---|---|
| | Yellow | Magenta | Cyan | Black |
| ~1min | 95% | 92% | 97% | 90% |
| 1~5min | 90% | 91% | 92% | 85% |
| 5~10min | 85% | 89% | 88% | 80% |
| 10~30min | 80% | 85% | 82% | 68% |
| 30~120min | 75% | 76% | 76% | 57% |
| 120min~ | 73% | 70% | 75% | 55% |

INKJET PRINTING APPARATUS

BACKGROUND

Field

The present disclosure relates to inkjet printing apparatuses.

Description of the Related Art

Japanese Patent Application Laid-Open No. 2007-245386 discusses an apparatus that estimates the amount of waste liquid ejected to a waste liquid receiving portion provided in a platen by calculating the amount of evaporation based on a temperature and/or humidity condition in a case of borderless printing. The apparatus takes the amount of evaporation into consideration to accurately estimate the amount of waste liquid that is disposed of during borderless printing.

The apparatus discussed in Japanese Patent Application Laid-Open No. 2007-245386 does not take into consideration a distance from an ink-ejected position to a waste ink storage container. Thus, the apparatus estimates the amount of waste liquid by uniformly calculating the amount of evaporation regardless of the position to which the ink is ejected. A time taken to store the ink in the waste ink storage container can vary depending on the distance from the position to which the ink is ejected, to the waste ink storage container. When the time taken to store the ink in the waste ink storage container varies, the amount of ink that evaporates during that time also varies. Thus, in some cases, accurate estimation of the amount of waste ink may not be possible when the amount of evaporation is calculated without taking into consideration the position to which the ink is ejected.

SUMMARY

The present disclosure is directed to an inkjet printing apparatus that accurately estimates the amount of waste ink stored in a waste ink storage container.

According to an aspect of the present disclosure, an inkjet printing apparatus includes a head configured to eject ink to print on a printing medium, a platen configured to support the printing medium that is conveyed at a position facing the head, a platen absorbent provided in the platen and configured to temporarily store ink ejected from the head, a waste ink storage container configured to store ink discharged from the platen absorbent in the waste ink storage container, and an estimation unit configured to, in a case where the platen is divided into a plurality of regions in a direction which intersects a conveyance direction of the printing medium, estimate an amount of ink stored in the waste ink storage container based on a position of a region to which the ink is ejected by the head and an amount of ink ejected to the region.

Further features will become apparent from the following description of exemplary embodiments with reference to the attached drawings.

BRIEF DESCRIPTION OF THE DRAWINGS

FIG. 5 illustrates stored ejection information according to the first exemplary embodiment.

FIG. 7 illustrates the percentage of remaining ink relative to the elapsed time according to the first exemplary embodiment.

FIG. 8 illustrates the amount of time needed for arrival relative to the amount of ejection according to a second exemplary embodiment.

FIG. 9 illustrates the percentage of remaining ink relative to the elapsed time according to a third exemplary embodiment.

DESCRIPTION OF THE EMBODIMENTS

The following describes an inkjet printing apparatus (printing apparatus) according to a first exemplary embodiment with reference to the drawings. While an embodiment is applied to a serial inkjet printing apparatus as an example, this example is not seen to be limiting. An exemplary embodiment is also applicable to a line-type inkjet printing apparatus including a line head that ejects ink across the full length of a printing medium.

Figure 1:
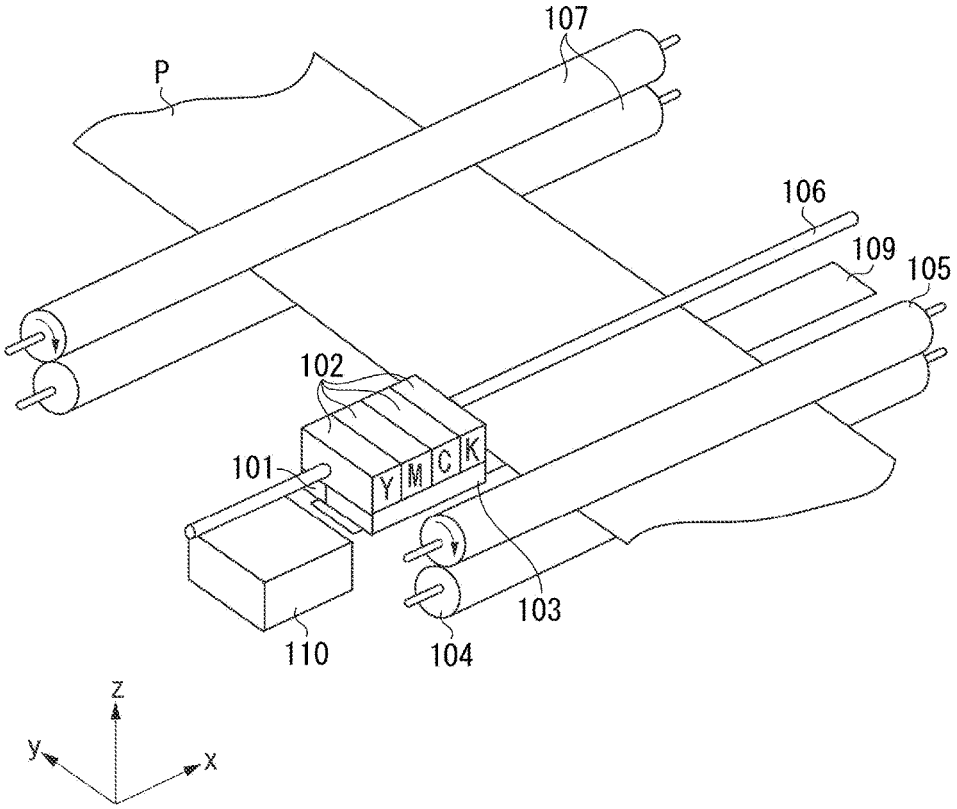
FIG. 1 schematically illustrates an inkjet printing apparatus according to a first exemplary embodiment.

FIG. 1 schematically illustrates the inkjet printing apparatus according to the present exemplary embodiment. A printing head 101 is detachably attached to a carriage 103. Ink tanks 102 of four colors including yellow Y, magenta M, cyan C, and black K are detachably attached to the carriage 103. The ink tanks 102 of the respective colors are individually replaceable. The ink tanks 102 respectively supply ink to eject openings (nozzles) of the printing head 101 corresponding to each color. The ink inside the ink tanks 102 is held by a negative pressure generation member inside the ink tanks 102. The carriage 103 is configured to be reciprocated by a driving motor (not illustrated) in a first direction (x-direction) along a carriage shaft 106.

Platen 109 is provided in a position facing the printing head 101. A printing medium P (printing sheet) rests on the platen 109. Conveyance roller 104 and pinch roller 105 are provided on an upstream side of the printing head 101 in a conveyance direction in which the printing medium P is conveyed. The conveyance roller 104 is driven and rotated by a conveyance motor (not illustrated). The pinch roller 105 is situated to face the conveyance roller 104. The pinch roller 105 is driven and rotated by the rotation of the conveyance roller 104. The conveyance roller 104 and the pinch roller 105 sandwich the printing medium P on the upstream side in the conveyance direction in which the printing medium P is conveyed. A pair of discharge rollers 107 are provided on a downstream side of the printing head 101 in the conveyance direction. The pair of discharge rollers 107 sandwiches the printing medium P on the downstream side in the conveyance direction. The printing medium P is sandwiched and conveyed under a tension generated between the conveyance roller 104, the pinch roller 105, and the pair of discharge rollers 107.

A single band image (one line) with ink droplets ejected from the printing head 101 attached to the carriage 103 is formed on the conveyed printing medium P. The carriage 103 moves in the first direction while the conveyance is stopped. After the one band image is formed, the conveyance roller 104 is driven by the conveyance motor to move the printing medium P by a predetermined amount in a second direction (y-direction) intersecting the first direction. The reciprocal movement of the carriage 103 and the ejection of ink droplets from the printing head 101, and the conveyance (intermittent conveyance) of the printing medium P by the predetermined amount by the conveyance roller 104 are alternately repeated to form an image of one page on the printing medium P.

In borderless printing, the printing head 101 also ejects ink to a position extending outside an end portion of the printing medium P (position outside the printing medium). The ink ejected to the position outside the printing medium P is temporarily stored in a platen absorbent 201 provided in an ink receiving portion of the platen 109. The printing head 101 can perform an auxiliary eject operation of ejecting ink to the platen absorbent 201 in order to discharge internal thickened ink.

A maintenance unit 110 is provided outside a printing region in a moving range of the carriage 103. The maintenance unit 110 includes a wiping mechanism and a suction mechanism. The wiping mechanism can perform a wiping operation by bringing a wiper 312 into contact with the eject openings of the printing head 101 and wiping the eject openings with the wiper 312. The suction mechanism can perform a recovery suction operation by driving a pump 311 while the eject openings of the printing head 101 is covered with a cap 310 to suction ink from the eject openings of the printing head 101. The inkjet printing apparatus performs a maintenance operation, including the recovery suction operation, the auxiliary eject operation, and the wiping operation when needed in order to maintain the ejection performance of the printing head 101.

Figure 2:
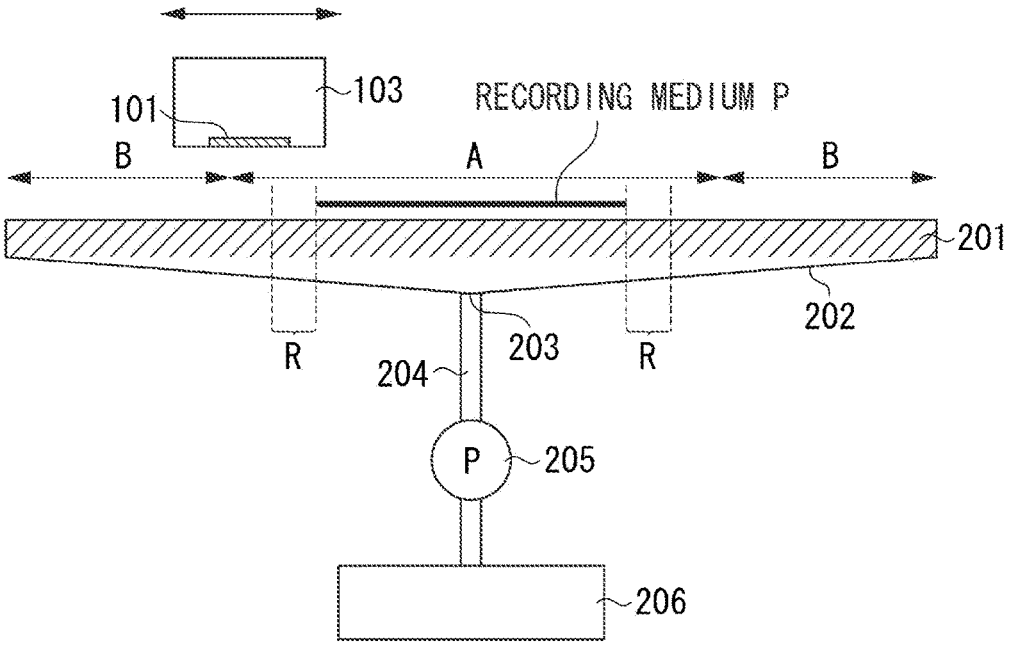
FIG. 2 is a schematic cross-sectional view illustrating the inkjet printing apparatus according to the first exemplary embodiment viewed from a discharge direction.

FIG. 2 is a schematic cross-sectional view illustrating the inkjet printing apparatus according to the present exemplary embodiment viewed from a discharge direction. In FIG. 2, the printing medium P is conveyed occupying a central portion of the platen 109. As described above, in the borderless printing, the printing head 101 also ejects ink to the position extending outside the end portion of the printing medium P. The ink ejected to the position outside the printing medium P is absorbed by the platen absorbent 201 located in regions R adjacent to the printing medium P in the x-direction. Similarly, the auxiliary eject operation during a printing operation is performed on the platen absorbent 201 located in the regions R adjacent to the printing medium P in order to increase the printing speed.

The ink ejected to the platen absorbent 201 runs down a slope 202 formed below the platen absorbent 201. The ink runs down the slope 202 to a suction opening 203 located at a central portion, so that the ink gathers near the suction opening 203. The gathered ink is retained near the suction opening 203. If an inclination angle of the slope 202 is increased, the height of the main body of the inkjet printing apparatus is increased, which hinders reducing the size of the inkjet printing apparatus. In a case of a printing apparatus that prints on a printing medium with a larger width, the height of the entire inkjet printing apparatus is significantly affected by the inclination angle of the slope. Thus, the angle of the slope 202 is desirably set to a minimum angle required to move the ink to the suction opening 203.

In a case where the printing head 101 ejects ink to the position outside the printing medium during the printing operation performed on a wide printing medium, the position to which the ink is ejected is located far from the suction opening 203 in the central portion. Thus, it takes a long time for the ejected ink to arrive in the suction opening 203. In a case of a printing medium with a smaller width, the position to which ink is ejected is relatively close to the suction opening 203, so it takes a relatively shorter time for the ejected ink to arrive in the suction opening 203. Thus, the time needed for the ejected ink to arrive in the suction opening 203 varies depending on the position to which the ink is ejected. When it takes a longer time for the ink to arrive in the suction opening 203, a larger amount of ink evaporates during that time. In other words, the amount of waste ink that arrives in the suction opening 203 decreases. When it takes a shorter time for the ink to arrive in the suction opening 203, a smaller amount of ink evaporates, and the amount of waste ink that arrives in the suction opening 203 increases. Specifically, the amount of waste ink in the case where the position to which ink is ejected is far from the suction opening 203 is smaller than that in the case where the position to which ink is ejected is close to the suction opening 203, even if the amount of the ejected ink in the former case is the same as that in the latter case.

The suction opening 203 is connected to a waste ink storage container 206, which is provided inside the main body of the inkjet printing apparatus, via a discharge tube 204. The discharge tube 204 is provided with a suction pump 205. The suction pump 205 is operated so that the ink arriving in the suction opening 203 is passed through the discharge tube 204 and discharged into the waste ink storage container 206. A region where negative pressure is generated by the operation of the suction pump 205 is limited to a region immediately above the suction opening 203. Specifically, the negative pressure only has a small effect on the ink located in an end portion of the platen absorbent 201, and a little amount of ink is suctioned when the suction pump 205 is operated.

The waste ink storage container 206 is substantially sealed from outside air so that the waste ink stored in the waste ink storage container 206 does not leak even when the main body of the inkjet printing apparatus is inclined. Accordingly, only a significantly small amount of evaporation of waste ink stored in the waste ink storage container 206 leaks. Information about the amount of waste ink discharged into the waste ink storage container 206 is stored in a non-volatile memory 318 described below. The waste ink storage container 206 is detachably attached to the main body of the inkjet printing apparatus, and when the inside of waste ink storage container 206 is filled with waste ink, a user can replace the waste ink storage container 206. When the amount of waste ink reaches a predefined amount, the ink can overflow, so the inkjet printing apparatus warns a user via an interface 306, which will be described below, that the waste ink storage container 206 needs to be replaced, etc.

Figure 3:
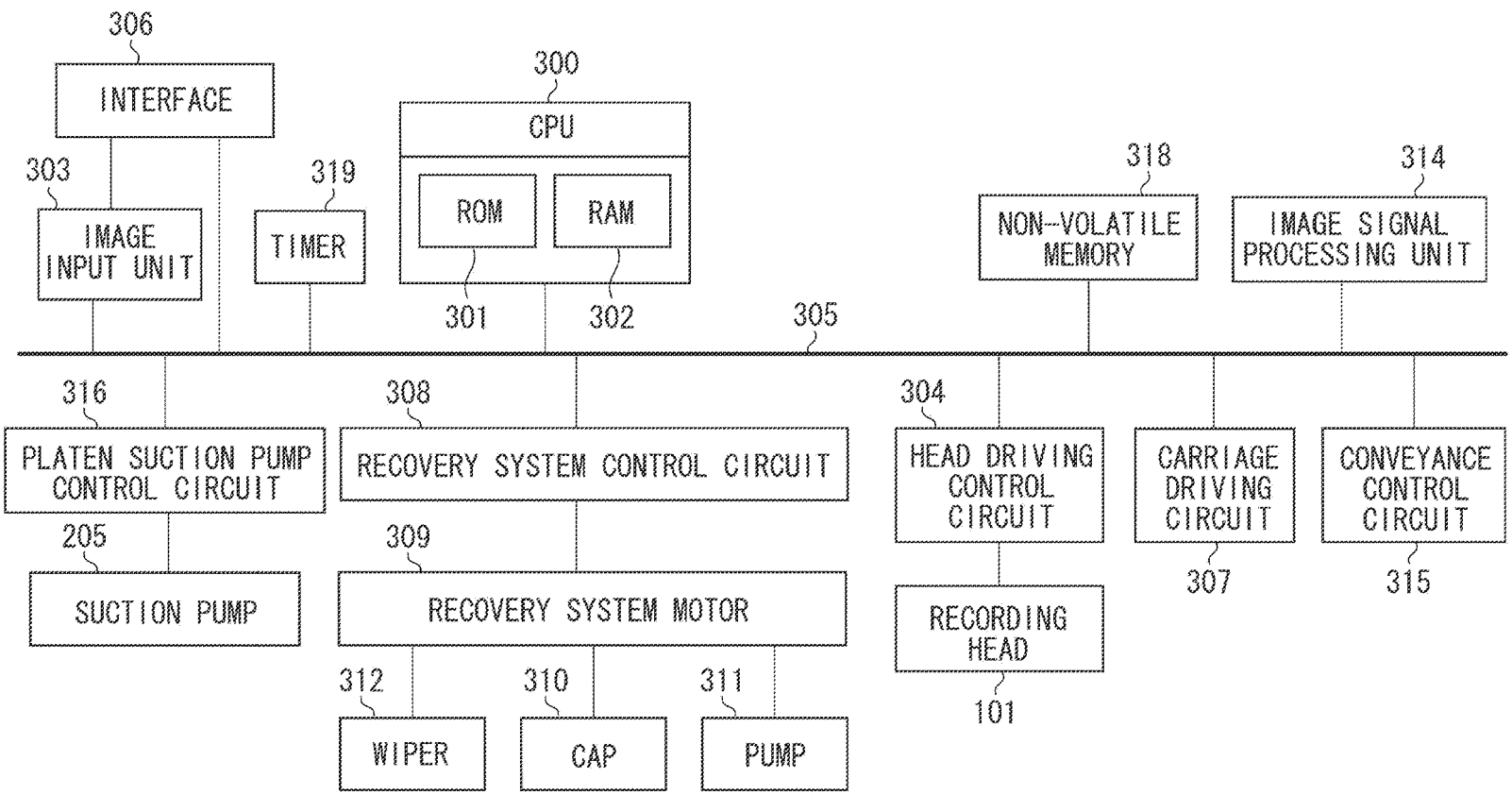
FIG. 3 is a block diagram illustrating the configuration of a control unit of the inkjet printing apparatus according to the first exemplary embodiment.

FIG. 3 is a block diagram illustrating the configuration of a control unit of the inkjet printing apparatus according to the present exemplary embodiment. In FIG. 3, a central processing unit (CPU) 300 controls the components of the inkjet printing apparatus and executes data processing via a main bus line 305. The CPU 300 performs the printing operation and the maintenance operation (recovery operation) by controlling the data processing, the driving of the printing head 101, and the driving of the carriage 103 via the below-described components according to a program stored in a read-only memory (ROM) 301. The CPU 300 communicates with a host apparatus via the interface 306. A random access memory (RAM) 302 is used as a work area for the data processing executed by the CPU 300, etc., and temporarily stores printing data of several lines, parameters relating to the recovery operation and supply operation, etc. An image input unit 303 can temporarily hold an image input from the host apparatus via the interface 306. The inkjet printing apparatus can notify the user via the interface 306 that the waste ink storage container 206 needs to be replaced because it is filled with waste ink, etc. The non-volatile memory 318 stores information about the amount of ink stored in the waste ink storage container 206, the amount of ink ejected to the platen absorbent, eject time, an ink type, etc. The non-volatile memory 318 can retain the information even if the inkjet printing apparatus is turned off.

A recovery system control circuit 308 controls the operations of the cap 310, the wiper 312, and the pump 311 by controlling the driving of a recovery system motor 309 according to a recovery processing program stored in the RAM 302. A head driving control circuit 304 controls the drive of the printing head 101 from which ink is to be ejected, and causes the printing head 101 to eject ink during the auxiliary eject operation and the printing operation. A carriage driving circuit 307 controls the reciprocal movement operation of the carriage 103 according to print data processed by an image signal processing unit 314, and also controls a moving operation to a position facing the maintenance unit 110 for execution of the suction operation. A conveyance control circuit 315 performs control such that the printing medium is conveyed (intermittently conveyed) in the conveyance direction (y-direction) by a predetermined amount to print an image corresponding to printing data of the next line after the printing head 101 completes the printing operation of one line. A platen suction pump control circuit 316 controls the suction pump 205, which suctions the waste ink, and controls the operation of the suction pump 205 based on the information stored in the RAM 302, i.e., information about the amount of ink ejected to the platen absorbent 201 and time information from a timer 319.

Figure 4:
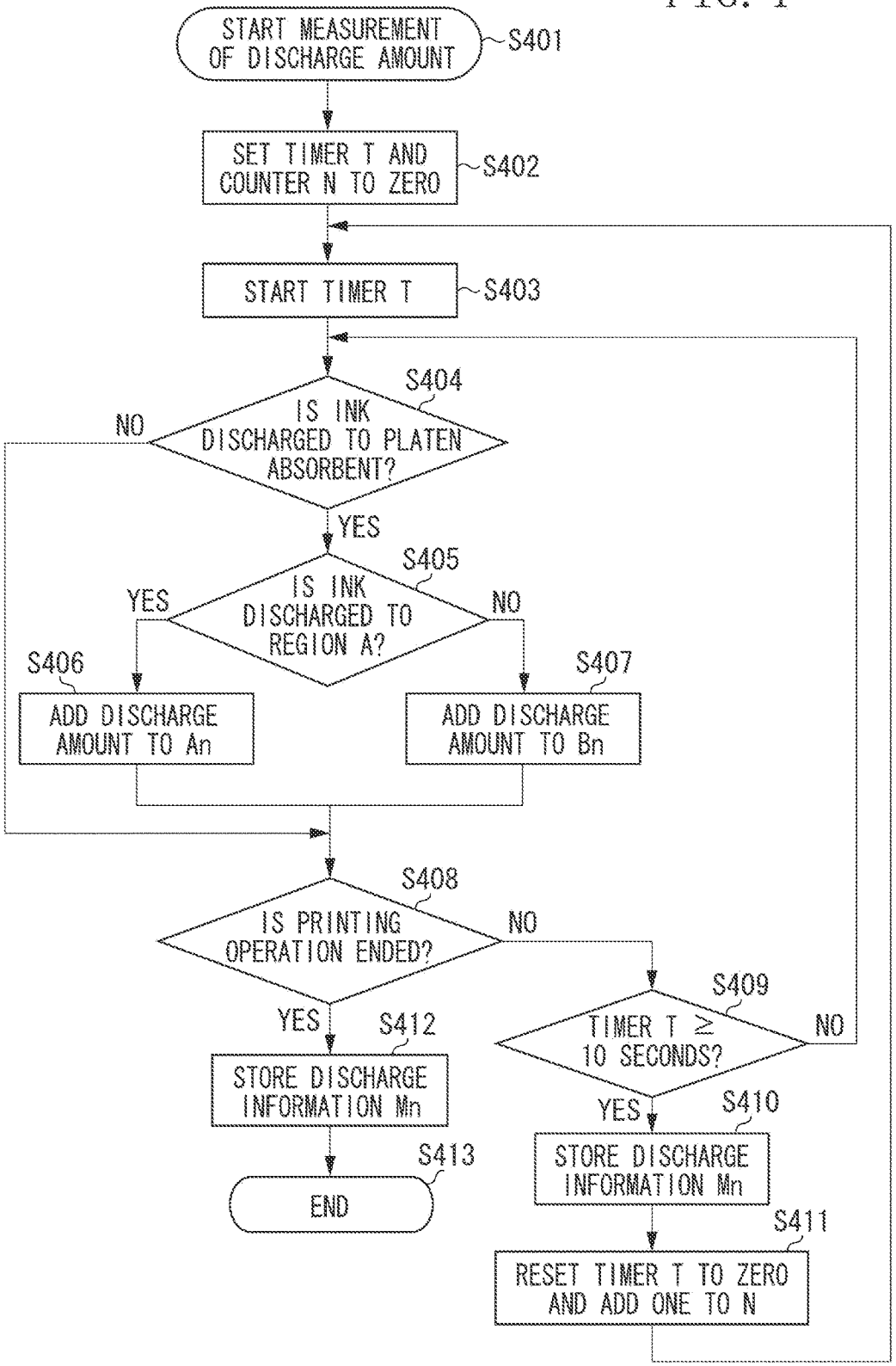
FIG. 4 illustrates a control sequence of a process of measuring the ink amount ejected to a platen absorbent according to the first exemplary embodiment.

Next, the following describes a control sequence of measuring the amount of ejection to the platen absorbent 201 according to the present exemplary embodiment, with reference to FIG. 4. In step S401, the control sequence is started when the inkjet printing apparatus starts the printing operation. In step S402, a timer T and a counter N are set to zero. Next, in step S403, the timer T is started to measure elapsed time. In step S404, it is determined whether ink is ejected to the platen absorbent 201 during the printing operation. Examples where the ink is ejected to the platen absorbent 201 include ejecting ink to a position extending outside a printing medium during borderless printing and ejecting ink to a position extending outside a printing medium during execution of the auxiliary eject operation. In step S404, if it is determined that the ink is ejected to the platen absorbent 201 (YES in step S404), then in step S405, the position to which the ink is ejected is identified. In the present exemplary embodiment, as illustrated in FIG. 2, the platen 109 is divided into regions A and B. The region A is a region close to the suction opening 203 and the region B is a region located at a distance greater from the suction opening 203 than the distance of the region A from the suction opening 203. Then, in step S405, it is determined whether the ink is ejected to the region A or B. While the platen 109 is divided into the regions A and B in the present exemplary embodiment, this is not seen to be limiting, and the platen 109 can be divided into any plurality of regions. If it is determined that the ink is ejected to the region A (YES in step S405), the processing proceeds to step S406. In step S406, the amount of ink ejected to the region A is added to a stored ejection amount An. The amount of the ejected ink is calculated by multiplying the amount of ejection per droplet by the number of ejections. If it is determined that the ink is ejected to the region B (NO in step S405), the processing proceeds to step S407. In step S407, the amount of ink ejected to the region B is added to a stored ejection amount Bn, as in step S406.

Next, in step S408, it is determined whether the printing operation has ended. If it is determined that the printing operation has not ended (NO in step S408), the processing proceeds to step S409. In step S409, it is determined whether the timer T is greater than or equal to 10 seconds (predetermined amount of time). In step S409, if it is determined that the timer T is less than 10 seconds (predetermined amount of time) (NO in step S409), the processing returns to step S404, and the processing of measuring the amount of ink ejected to the platen absorbent 201 is performed again in steps S404 to S407. If, in step S409, it is determined that the timer T is greater than or equal to 10 seconds (predetermined amount of time) (YES in step S409), the processing proceeds to step S410. While the predetermined amount of time is set to 10 seconds step S409 in the present exemplary embodiment, this is not seen to be limiting, and any time can be set. In step S410, the amounts of droplets An and Bn ejected in the 10 seconds are stored as ejection information Mn in association with the eject time and estimated arrival time when the ink is expected to arrive in the suction opening 203. Then, in step S411, the timer T is reset to zero, and one is added to N. The processing then returns to step S403, and the timer T is started. The sequence is repeated until it is determined in step S408 that the printing operation has ended. In this way, the ejection information Mn can be stored at every predetermined time interval (10 seconds) until the end of the printing operation.

FIG. 5 illustrates the stored ejection information Mn in the present exemplary embodiment. In FIG. 5, the ejection information Mn indicates information about the ejection to the platen absorbent 201 that is performed every 10 seconds since the start of the printing. The ejection amount An to the region A, the eject time, and the above-described estimated arrival time are stored in the ejection information Mn. Similarly, the amount of ejection Bn made to the region B, the eject time, and the estimated arrival time are stored. In FIG. 5, the estimated arrival time at the region A is set to four minutes after the eject time, and the estimated arrival time at the region B is set to eight minutes after the eject time. That is, an amount of time needed for arrival in which the ejected ink is expected to arrive at the suction opening 203 is added to the eject time for each of the regions A and B. In FIG. 5, the amount of time needed to arrive is four minutes for the ink ejected to the region A and eight minutes for the ink ejected to the region B. Since the eject time and the estimated arrival time are the ejection information stored every ten seconds, the stored time is in units of 10 seconds.

In step S408, if it is determined that the printing operation has ended (YES in step S408), the processing proceeds to step S412. In step S412, the ejection amounts An and Bn in the 10 seconds are stored in association with the eject time and the estimated arrival time as ejection information Mn, similar to step S410. Then, in step S413, the control sequence of the process of measuring the amount of ejection made to the platen absorbent 201 ends.

Figure 6:
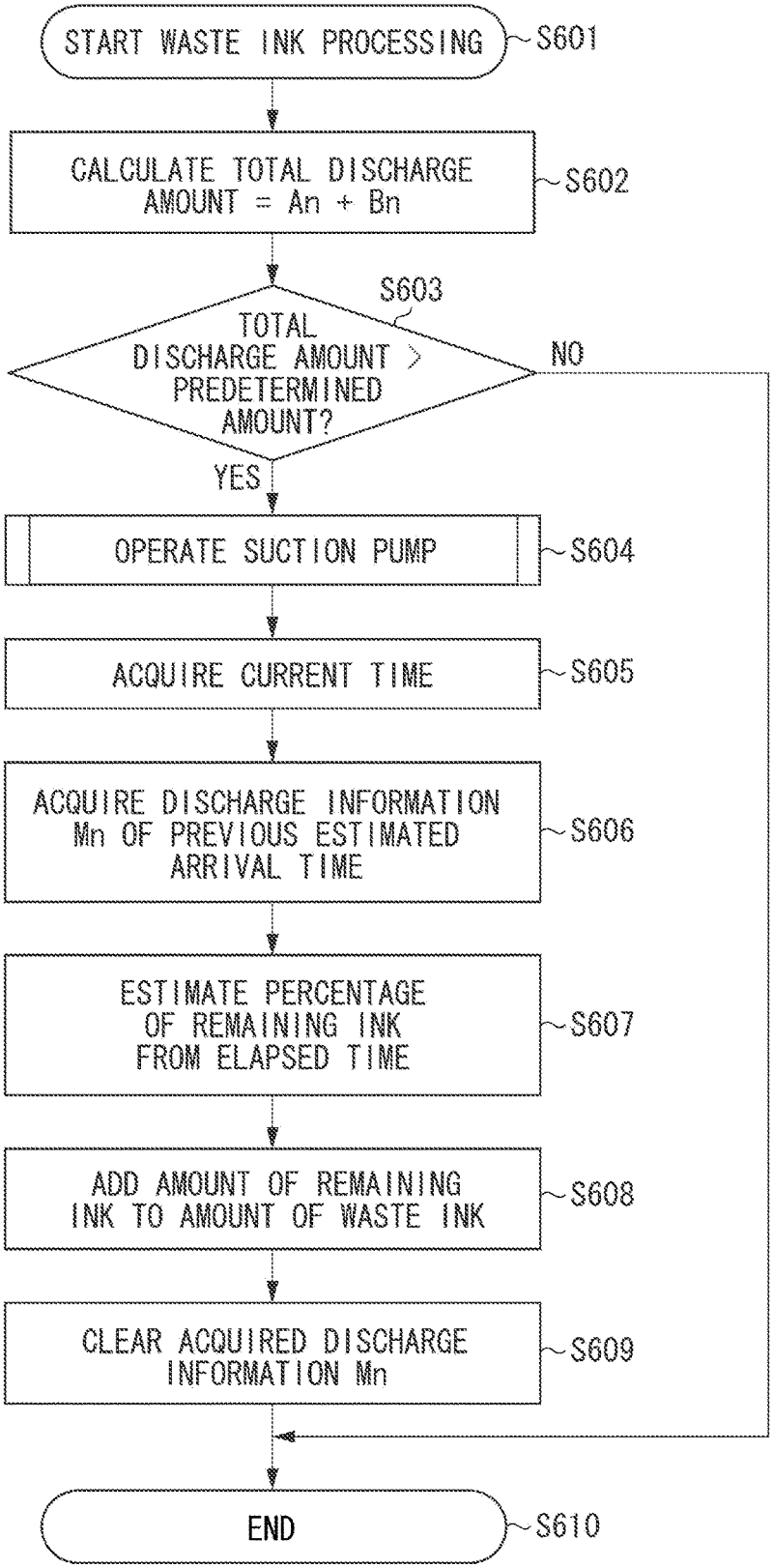
FIG. 6 illustrates a control sequence of a process of processing waste ink according to the first exemplary embodiment.

The following describes a control sequence of a process of processing waste ink according to the present exemplary embodiment with reference to FIG. 6. In the present exemplary embodiment, after the printing operation has ended, a discharge operation is performed to discharge the printing medium on which the printing operation is completed external to the inkjet printing apparatus. Then, after the discharge operation on the printing medium is completed, the control sequence of processing waste ink ejected to the platen absorbent 201 is executed. The control sequence includes checking the amount of ink ejected to the platen absorbent 201, operating the suction pump 205 such that the ink does not overflow from the platen 109, and discharging the ink ejected to the platen absorbent 201 from the suction opening 203 to the waste ink storage container 206.

In step S601, after the discharge of the printing medium is completed, the control sequence of processing waste ink ejected to the platen absorbent 201 is started. In step S602, the total amount of ink ejected to the platen absorbent 201 is calculated from a total value of the ejection amounts An and Bn stored in FIG. 5. In step S603, whether the total amount of ejection exceeds a predetermined amount is determined. If it is determined that the total amount of ejection does not exceed the predetermined amount (NO in step S603), then in step S610, the control sequence ends. If it is determined that the total amount of ejection exceeds the predetermined amount (YES in step S603), the processing proceeds to step S604, and the suction pump 205 is operated. The predetermined amount is an amount in which the ink does not overflow from the platen absorbent 201.

In step S604, the suction pump 205 is operated to discharge the ink retained near the suction opening 203 to the waste ink storage container 206. Next, in step S605, the current time is acquired from the timer of the inkjet printing apparatus. In step S606, the ejection information Mn that includes a previous estimated arrival time preceding the current time obtained in step S605 is acquired. Then, the elapsed time after the ejection of each ink is calculated from a difference between eject time included in the acquired ejection information Mn and the current time. In step S607, the percentage of remaining ink that corresponds to the calculated elapsed time is estimated by referring to FIG. 7.

FIG. 7 illustrates the percentage of remaining ink relative to the elapsed time according to the present exemplary embodiment. The percentage of remaining ink refers to the percentage of the ink remaining after the ink is evaporated in the elapsed time. The percentage of remaining ink illustrated in FIG. 7 is a value obtained by subtracting an ink evaporation rate (%) from 100%. The values of the percentage of remaining ink relative to the elapsed time are acquired by prior experiments and the like and stored in advance in the inkjet printing apparatus. In step S607 in FIG. 6, the percentage of remaining ink that corresponds to the calculated elapsed time is estimated by referring to a correspondence table illustrated in FIG. 7.

In step S608, the amount of remaining ink is calculated by multiplying the ejection amount An and the ejection amount Bn included in the ejection information Mn by the percentage of remaining ink. Then, the calculated amount of remaining ink is added to the previously-stored amount of waste ink in the waste ink storage container 206 as the amount of waste ink discharged in this waste ink processing.

In step S609, the ejection information Mn acquired in step S606 is cleared. At this time, the ejection information Mn that has not reached the estimated arrival time in step S606 is information about waste ink that has not yet arrived in the suction opening 203. Therefore, the ejection information Mn is not added to the amount of waste ink in the waste ink storage container 206. In addition, the ejection information Mn is not cleared. Then, in step S610, the control sequence of processing waste ink ends.

While the control sequence of processing waste ink is executed after the discharge operation on the printing medium is completed in the present exemplary embodiment, this is not seen to be limiting. For example, the control sequence can be executed at any timing at which the printing operation is not disturbed, for example, when the software power in the inkjet printing apparatus is turned off or when the suction recovery operation on the printing head is being performed.

As described above, in the present exemplary embodiment, the platen is divided into the plurality of regions, and the amount of time needed for moving the ejected ink from the region to which the ink is ejected to the suction opening is estimated for each of the regions. Then, the amount of each remaining ink is calculated and added as the amount of waste ink discharged into the waste ink storage container. In this way, the amount of evaporation corresponding to the position to which the ink is ejected is taken into consideration to accurately estimate the amount of waste ink in the waste ink storage container. This enables prompting the user at appropriate timing to replace the waste ink storage container.

Next, a second exemplary embodiment is described with reference to the drawings. Description of configurations similar to those in the first exemplary embodiment is omitted.

In the first exemplary embodiment, the amount of time needed for arrival is uniformly set with respect to all inks ejected to the same region of the divided platen regardless of the amount of ejected ink. In a configuration according to the second exemplary embodiment, the amount of time needed for arrival is estimated based on the amount of ink ejected per unit time for each region.

The control sequence of measuring the amount of ejection to the platen absorbent is similar to the control sequence according to the first exemplary embodiment (FIG. 4). However, in the present exemplary embodiment, the amount of time needed for arrival that is associated with the ejection amounts An and Bn is estimated in steps S410 and S412 of FIG. 4 using a correspondence table illustrated in FIG. 8. Then, the estimated amount of time needed for arrival is added to the eject time to obtain the estimated arrival time.

FIG. 8 illustrates the amount of time needed for arrival relative to the amount of ejection according to the present exemplary embodiment. In FIG. 8, the amount of ejection refers to the amount of ink ejected to the region in the predetermined time (10 seconds). The larger the amount of ejection, the shorter the amount of time needed for arrival at the suction opening, because as the amount of ejected ink increases, the amount of ink retained per unit area in the slope also increases, and flow resistance of the ink applied per unit volume decreases. As described above, the arrival time is estimated based on the amount of ink ejected to the region, so that the amount of remaining ink is more accurately calculated to enable accurate estimation of the amount of waste ink.

The speed at which the ink moves down the slope varies depending on the viscosity of the ink. The viscosity of the ink varies depending on the ink type, and the temperature and humidity in an environment in which the main body of the apparatus is installed. Accordingly, in FIG. 8, different amounts of time needed for arrival can be set according to the ink type, and the temperature and humidity in the environment in which the main body of the apparatus is installed. A measurement instrument, such as a thermo-hygrometer, can be provided in the printing apparatus to measure the temperature and humidity.

As described above, according to the present exemplary embodiment, by taking into consideration the amount of evaporation based on the position to which the ink is ejected and the amount of ink, the amount of waste ink in the waste ink storage container can be accurately estimated. Thus, the user can be prompted at appropriate timing to replace the waste ink storage container.

The following describes a third exemplary embodiment with reference to the drawings. Description of configurations similar to those in the first exemplary embodiment is omitted.

In the present exemplary embodiment, a case where the amount of remaining ink is estimated based on the type of ejected ink will be described.

The control sequence of measuring the amount of droplets ejected to the platen absorbent in the printing operation is similar to the control sequence according to the first exemplary embodiment (FIG. 4). However, in the present exemplary embodiment, in steps S410 and S412 in FIG. 4, the amounts of the ejected droplets, An and Bn, are stored for each ink type (yellow, magenta, cyan, black). The control sequence of processing the waste ink is similar to the control sequence according to the first exemplary embodiment (FIG. 6). However, in the present exemplary embodiment, the amount of remaining ink is estimated in step S607 in FIG. 6 based on the ink type by referring to a correspondence table illustrated in FIG. 9.

FIG. 9 illustrates the percentage of remaining ink relative to the elapsed time according to the present exemplary embodiment. In FIG. 9, different percentages of remaining ink relative to the elapsed time are set for the respective ink types. This is because the respective ink types have different ink solvent components, which lead to different evaporation speeds and different amounts of remaining ink.

The different evaporation speeds and different amounts of remaining ink are caused by factors other than the ink type. For example, the temperature and humidity in the environment in which the inkjet printing apparatus is installed affects evaporation speed and remaining ink amount. Therefore, in FIG. 9, different percentages of remaining ink can be estimated based on the temperature and humidity in the environment in which the inkjet printing apparatus is located. A measurement instrument, such as a thermohygrometer, can be provided in the inkjet printing apparatus to measure the temperature and humidity.

As described above, according to the present exemplary embodiment, the ink type and the amount of evaporation based on the position to which the ink is ejected are taken into consideration to enable accurate estimation of the amount of waste ink in the waste ink storage container. Therefore, the user can be prompted at appropriate timing to replace the waste ink storage container.

Exemplary embodiments provide an inkjet printing apparatus that accurately estimates the amount of waste ink stored in a waste ink storage container.

While exemplary embodiments have been provided, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-125594, filed Jun. 24, 2016, which is hereby incorporated by reference herein in its entirety.

What is claimed is:

1. An inkjet printing apparatus comprising:

a head configured to eject ink to print on a printing medium;

a platen configured to support the printing medium that is conveyed at a position facing the head;

a platen absorbent provided in the platen and configured to receive ink ejected from the head;

an ink storage container configured to store ink discharged from the platen absorbent;

a discharge tube through which the ink received by the platen absorbent is discharged to the ink storage container, wherein the platen absorbent includes a first region and a second region that is more distant from the discharge tube than the first region; and a calculating unit configured to calculate an amount of ink stored in the ink storage container, wherein the calculating unit calculates the amount of ink as a sum of a first amount of ink ejected to the first region multiplied by a first coefficient and a second amount of ink ejected to the second region multiplied by a second coefficient that is less than the first coefficient.

2. The inkjet printing apparatus according to claim 1, wherein the calculating unit calculates the amount of ink stored in the ink storage container further based on first time information about a time when the first amount of ink is ejected and second time information about a time when the second amount of ink is ejected.

3. The inkjet printing apparatus according to claim 2, wherein the calculating unit calculates the amount of ink stored in the ink storage container at predetermined time intervals.

4. The inkjet printing apparatus according to claim 3, wherein the predetermined time intervals are between a start of a printing operation and a time when the printing operation ends.

5. The inkjet printing apparatus according to claim 2, wherein the calculating unit calculates the amount of ink stored in the ink storage container further based on third time information obtained by adding a first amount of time to the time when the first amount of ink is ejected and fourth time information obtained by adding a second amount of time different from the first amount of time to the time when the second amount of ink is ejected.

6. The inkjet printing apparatus according to claim 5, wherein the calculating unit calculates the amount of ink stored in the ink storage container at predetermined time intervals.

7. The inkjet printing apparatus according to claim 2, wherein the calculating unit calculates the amount of ink stored in the ink storage container further based on fifth time information obtained by adding a third amount of time corresponding to the first amount of ink to the time when the first amount of ink is ejected, and sixth time information obtained by adding a fourth amount of time corresponding to the second amount of ink to the time when the second amount of ink is ejected.

8. The inkjet printing apparatus according to claim 7, wherein the calculating unit calculates the amount of ink stored in the ink storage container at predetermined time intervals.

9. The inkjet printing apparatus according to claim 1, wherein the calculating unit calculates the amount of ink stored in the ink storage container further based on current time information and information about times when the ink is ejected to each of the plurality of regions.

10. The inkjet printing apparatus according to claim 9, wherein the calculating unit calculates an amount of remaining ink after the ink ejected to the platen absorbent evaporates based on the current time information and the information about times when the ink is ejected to each of the plurality of regions, and calculates the amount of ink stored in the ink storage container further based on the amount of remaining ink.

11. The inkjet printing apparatus according to claim 10, wherein the calculating unit calculates the amount of ink stored in the ink storage container by further adding the amount of remaining ink that is calculated after a printing operation to the amount of ink stored in the ink storage container that is calculated before the printing operation.

12. The inkjet printing apparatus according to claim 1, wherein the calculating unit calculates the amount of ink stored in the ink storage container further based on a type of ink ejected to the plurality of regions.

13. The inkjet printing apparatus according to claim 1, wherein the calculating unit calculates the amount of ink stored in the ink storage container further based on information about temperature or humidity in an environment where the inkjet printing apparatus is located.

14. The inkjet printing apparatus according to claim 1, further comprising:

a carriage configured to reciprocate and on which the head is mounted; and an ink tank detachably mounted on the carriage and configured to store the ink to be supplied to the head.

15. The inkjet printing apparatus according to claim 1, wherein a lower portion of the platen absorbent includes a slope that is inclined toward a central portion of the platen absorbent.

16. The inkjet printing apparatus according to claim 1, further comprising a suction pump provided in the discharge tube and configured to perform a suction operation to discharge the ink retained in a lower portion of the platen absorbent to the ink storage container.

17. The inkjet printing apparatus according to claim 16, wherein the suction pump starts the suction operation after the printing medium on which the head ejects ink to print is discharged from the inkjet printing apparatus.

18. The inkjet printing apparatus according to claim 16, wherein the suction pump starts the suction operation when an amount of ink ejected to the platen absorbent exceeds a predetermined amount.

* * * * *